United States Patent [19]

Lebouc

[11] Patent Number: 4,653,435

[45] Date of Patent: Mar. 31, 1987

[54] SLUDGE REMOVAL DEVICE FOR CLEANING THE TUBULAR PLATE OF A STEAM GENERATOR

[75] Inventor: Bernard Lebouc, Courbevoie, France

[73] Assignee: Framatome et Cie, Courbevoie, France

[21] Appl. No.: 795,556

[22] Filed: Nov. 6, 1985

[30] Foreign Application Priority Data

Nov. 13, 1984 [FR] France ..... 84 17289

[51] Int. Cl.[4] ..... F22B 37/54; F28F 15/00; F28G 9/00

[52] U.S. Cl. ..... 122/382; 122/392

[58] Field of Search ..... 122/381, 382, 391, 392, 122/390; 134/22.18; 165/95; 15/316 R

[56] References Cited

U.S. PATENT DOCUMENTS 3,915,122 10/1975 Schroder ..... 122/382 X 4,424,769 1/1984 Charamathieu et al. ..... 122/391 X 4,526,135 7/1985 Calhoun et al. ..... 122/392 X

*Primary Examiner*—Edward G. Favors

*Attorney, Agent, or Firm*—Pollock, Vande Sande & Priddy

[57] ABSTRACT

The device comprises at least one assembly insertable in the enclosure through a hole situated in the vicinity of the tubular plate. Said assembly comprises a suction pipe having a curved part insertable in the casing through the hole and of a shape such that it terminates in the immediate vicinity of the plate, between the enclosure and the stack of tubes and a conduit placed inside the pipe, for connection to a cleaning liquid supply, ending in a nozzle for projecting water in a transverse direction to the pipe, along a grazing path with respect to the tubular plate and in the circumferential direction of the enclosure.

11 Claims, 16 Drawing Figures

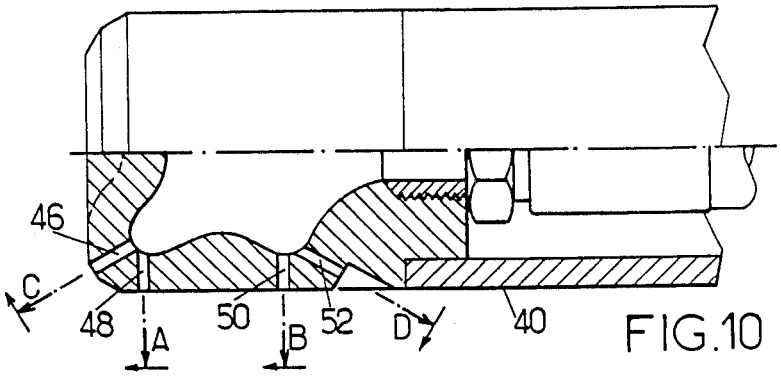
FIG.10
FIG.10A.
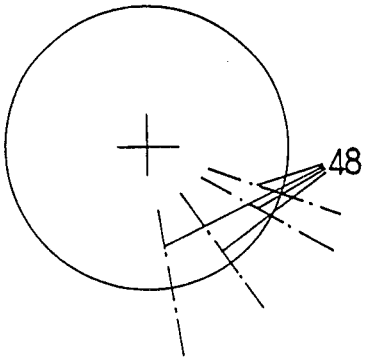
FIG.10B.
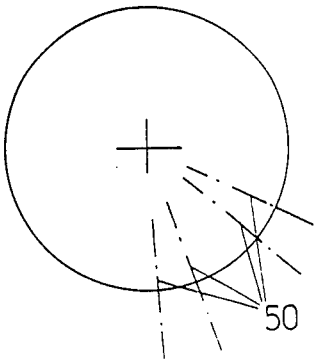
FIG.10C.
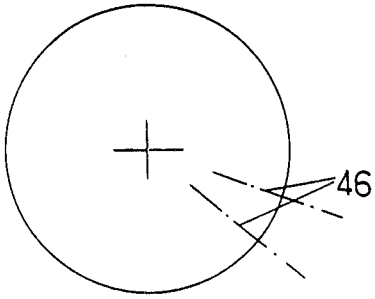
FIG.10D.
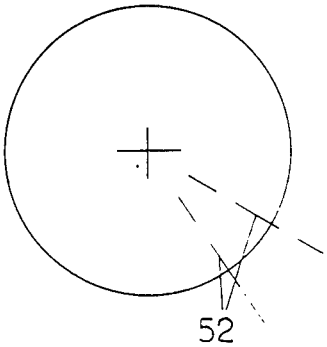

SLUDGE REMOVAL DEVICE FOR CLEANING THE TUBULAR PLATE OF A STEAM GENERATOR

FIELD OF THE INVENTION

The invention relates to sludge removal devices for use in an installation for cleaning the tubular plate of a steam generator of the type which comprises, in a cylindrical enclosure closed by the plate, a stack or bundle of parallel tubes sealingly connected to the plate, through which flows a primary high temperature fluid.

The invention relates more particularly to sludge removal devices arranged for generating a flow of cleaning liquid over the plate by injecting cleaning liquid, generally water, at the periphery of the plate and at a very low incidence and by sucking up water collected at the periphery of the plate.

The installation generally comprises, in addition to that device, at least one delivery tube, called a lance, movable radially between two adjacent rows of tubes, along a direction parallel to the tubular plate and in the vicinity thereof, the lance having an endmost part with nozzles directing oblique jets towards the tubular plate.

PRIOR ART

Numerous devices of the above-defined type are already known. French Pat. No. 2,352,269 discloses a device which comprises two assemblies which are inserted into the enclosure through a closable hole therein. Each assembly has two input nozzles directed symmetrically and in the tangential direction and two outlet nozzles. Thus two semi-circular circumferential flows are formed at the periphery of the tubular plate. This device has however drawbacks. The nozzles are introduced through the enclosure through the same hole as a lance or lancing for removing the deposits on the plate. The assembly has therefore a bulk such that it can only be inserted through a hole of large diameter. Now, such access holes are only found on certain steam generators and in addition they are generally placed very much above the tubular plate, which considerably complicates the construction and the positioning of the device. French Specification 2,514,108 describes an installation in which the sludge removal device and the delivery tubes are not introduced into the casing through different holes, which considerably simplifies the construction. However, the removal device in accordance with that specification again comprises cleaning liquid injection elements and suction elements which form separate assemblies which must be inserted separately, which increases the duration and the complexity of the positioning and removal operations.

OBJECT OF THE INVENTION

It is a general object of the invention to provide an improved sludge removal device for use in installations for cleaning tubular plates. It is a more specific object to provide a device which is simple in structure and easy to position and makes it possible to satisfactory scavenge the sludges placed in suspension by the lances attacking the layer of sludge which formed progressively and hardened during operation of the generator.

SUMMARY OF THE INVENTION

For this, the invention provides a device of the above-defined type, comprising at least one assembly insertable into the enclosure through a hole situated in the vicinity of and over the tubular plate, said assembly comprising: a curved suction pipe insertable into the casing through the hole and of a shape such that it terminates in the immediate vicinity of the plate, between the enclosure and the bundle of tubes; and a conduit placed inside the pipe, for connection to a cleaning liquid supply and having an outlet nozzle for projecting water in a direction transverse to the pipe, along a grazing path with respect to the tubular plate and in the circumferential direction of the enclosure.

The conduit may typically open into a liquid delivery or projection head projecting through the lateral wall of the pipe; intermediate its ends, the conduit may be held in the pipe by perforated centering devices spaced apart along the conduit.

The pipe is typically provided with a flange for sealing connection to the access hole formed in the casing. In some vapor generators, comprising a small sized hole called "eyehole", placed in the immediate vicinity of the plate, it will be possible to use a pipe having a rigid end portion and whose permanent curvature is sufficiently high for this end portion to be engaged through an eyehole until it comes in the immediate vicinity of the tubular plate, without abutting against the exchange tubes placed at the periphery of the bundle. In other cases, the thickness of the enclosure, the available distance between the bund bundle and the enclosure and/or the size of the access hole will be such that it will be necessary to form the end section of the pipe as a flexible pipe. The latter may be formed with the high radius of curvature required for introduction and adapted to bend so as to provide a good contact between the outlet of the pipe and the plate after insertion of the pipe. In practice, this flexible section may be formed by a bellows.

The invention is applicable whatever the type of regular distribution of the exchange tubes in the bundle. In particular, the device is suitable for use in an exchanger whose tubes are distributed according to a square lattice and it may then cooperate with sludge removal lances of the kind described in French Specification No. 2,514,108 already mentioned. The device may also be used in a heat exchanger where the tubes are distributed in a triangular lattice. In this case, it will be advantageously associated with one or more lances for attacking the sludges in the three directions of the elementary mesh of the lattice.

The invention will be better understood from the following description of particular embodiments given by way of examples.

BRIEF DESCRIPTION OF THE DRAWINGS

FIG. 3 is a detail view in cross-section through line III—III of FIG. 2;

FIG. 4 is a schematical isometric view showing the assembly of FIG. 2, separated from the balance of the device;

FIG. 10 is a schematical view, in half section, of the injection head of a sludge attacking lance, for obtaining the three attack directions shown in FIG. 9;

FIGS. 10A, 10B, 10C and 10D are sectional diagrams through the planes A, B, C and D of FIG. 10;

DETAILED DESCRIPTION OF AN EMBODIMENT

Before describing the invention, it may be useful to briefly recall the construction of the parts concerned by the invention of a steam generator for a light water cooled and moderated reactor.

Figure 1:
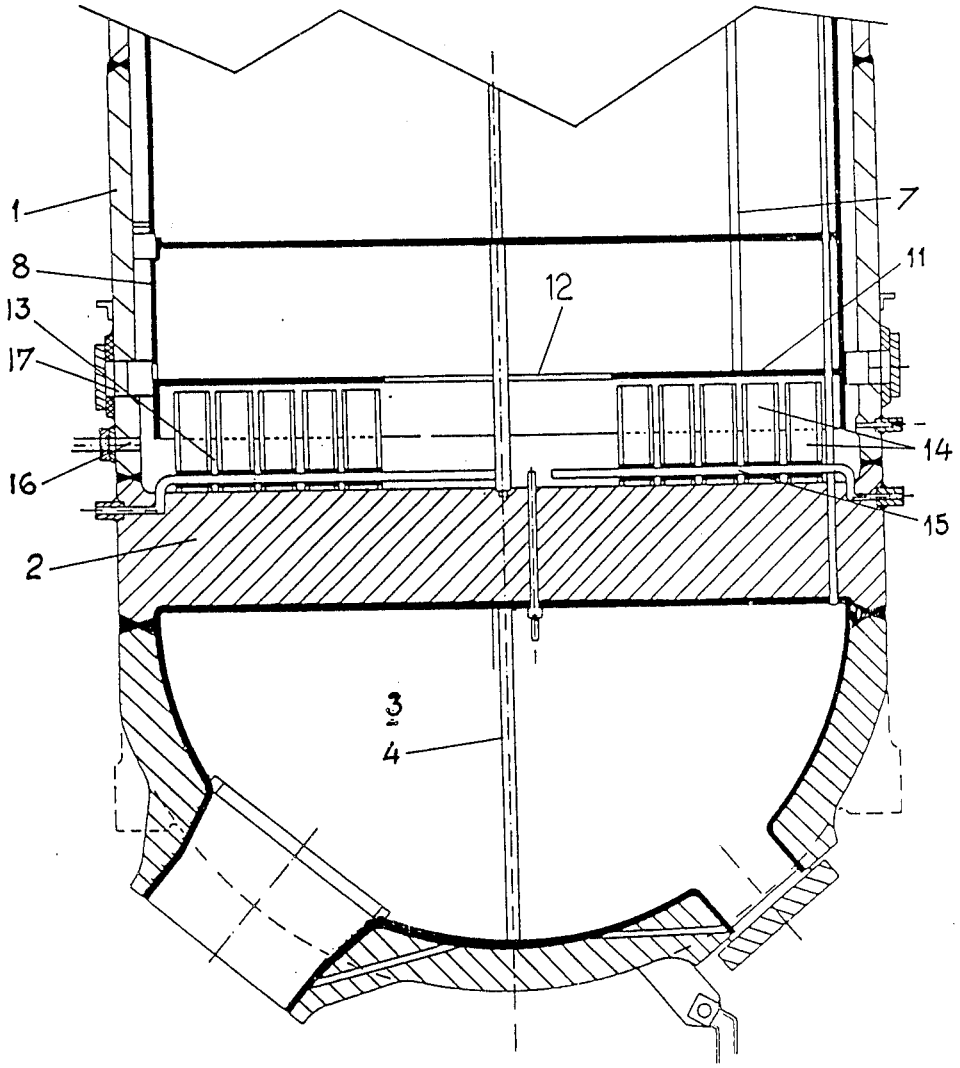
FIG. 1 is a vertical sectional view of the lower part of a steam generator showing the main components which are found in most steam generators.

The steam generator shown in FIG. 1 comprises a pressurized cylindrical enclosure 1 closed at its lower part by a tubular plate 2 in which the end portions of heat exchange U tubes, such as tube 7, are secured by flanging over and welding. The enclosure is extended, under plate 2, by a dome defining a water box 3, separated by a vertical dividing wall 4 into a compartment into which the hot primary water from the reactor arrives through piping and an outlet compartment from which the primary water flows in the U-shaped tubes.

Between the bundle of U-shaped tubes 7 and enclosure 1 is placed a secondary casing 8. The secondary casing 8 ends above the tubular plate while leaving a space so that the secondary water and the recirculation water which flow down through the annular space between the enclosure and the casing can supply the zone occupied by the bundle, immediately above the tubular plate. A distribution plate 11 comprising a central opening 12 is disposed above the tubular plate 2. The hot and cold legs of tubes 7 are separated by a free diametrical zone 13, called "water lane", where spacers 14 and a continuous drain ramp 15 are placed.

The introduction of tools for cleaning the plate can only take place through holes formed in the enclosure. The enclosure 1 shown comprises two holes of a relatively large diameter 17, called "hand holes", situated facing the "water lane" and at the level of the distribution plate 11. Two smaller holes, usually called "eyeholes", are aligned in a direction perpendicular to that of the "hand holes" at a small distance from the tubular plate 2. Often, two "eyeholes" 16 are also provided below the "hand holes". Holes 17 and 16, closed during normal operation by stoppers, correspond to holes formed in casing 8. In general, enclosure 1 is surrounded by a casemate (not shown) whose purpose is more especially to stop the pieces and debris projected should a malfunction occur.

Steam generators are not all provided with both "hand holes" and "eyeholes". But at least one or other of these types of holes are always to be found.

To remove these sludges which accumulate on the tubular plate 2, an installation is generally used having on the one hand means for attacking the layer of sludge, comprising at least one delivery tube or "lance" insertable into the enclosure, and on the other hand a removal device. This latter comprises several members insertable into the enclosure through the "eyeholes" or the "hand holes".

Figure 2:
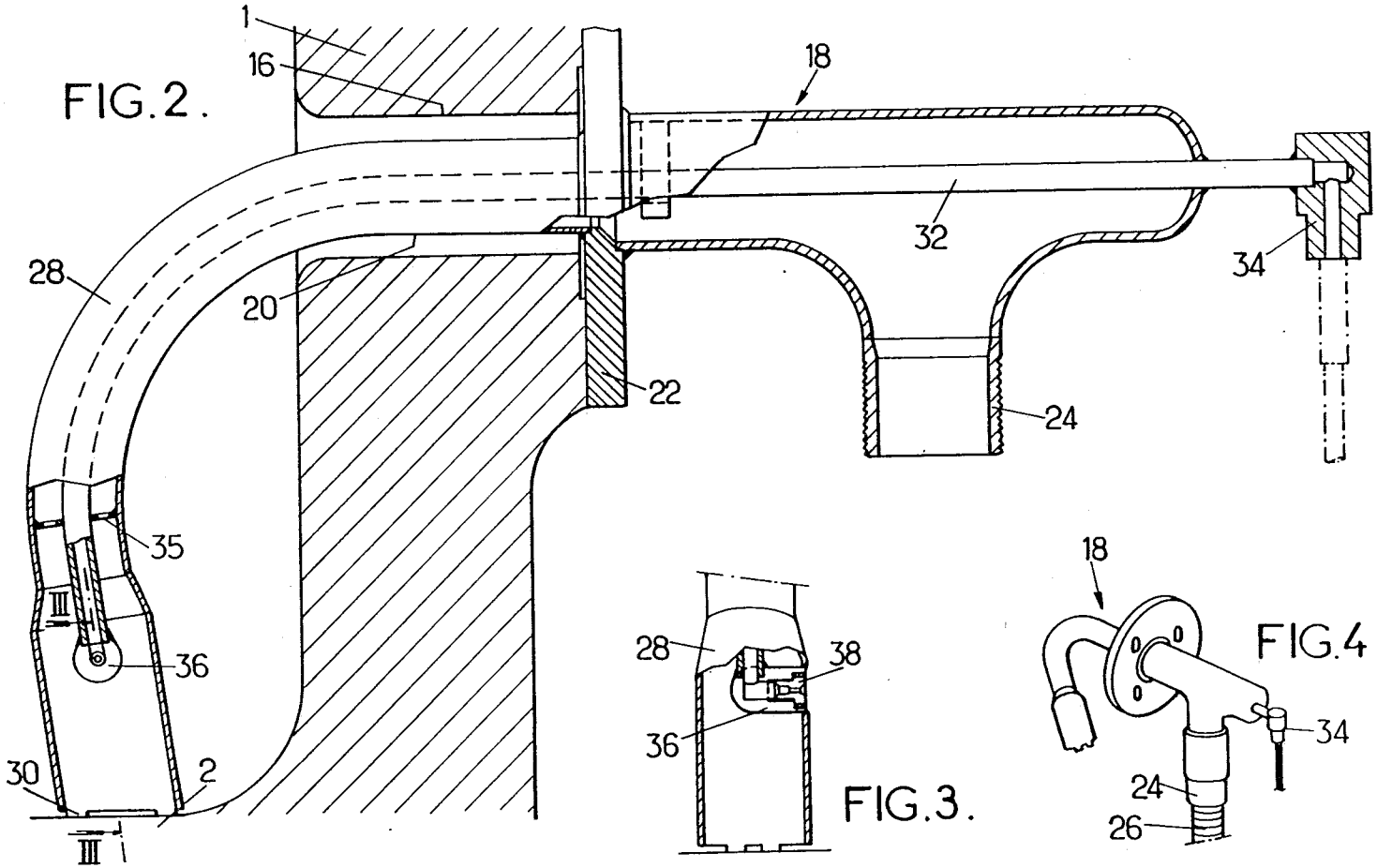
FIG. 2 shows one of the circulation and suction assemblies for a sludge removal device suitable for use in a steam generator of the kind shown in FIG. 1.

The insertable assembly shown in FIGS. 2 to 4 is intended to be introduced into the enclosure 1 through an "eyehole" 16 situated at 90° from the water lane. This assembly 18 is formed by a suction pipe 20 having a flange 22 for sealing connection to the enclosure, about the "eyehole", to replace the closure stopper. The rear part of this pipe is provided with a suction connection 24 intended to be connected by means of a flexible pipe 26 to a suction pump (not shown). The end portion 28 of pipe 20 insertable in the enclosure has a shape such that it may be introduced without jamming against the exchange tubes and, when it is in position, it bears against the tubular plate 2. The end of pipe 20 is advantageously enlarged and provided with terminal fingers 30 such that the outlet of the pipe is slightly immersed in the water layer which will cover the peripheral part of the plate during operation.

Assembly 18 also comprises means for causing the water to flow over the plate, comprising a rigid tube 32 held coaxially with respect to the pipe by perforated centering devices, not shown. The rear part of tube 32 projects outside the pipe and has an end piece 34 for connection to a flexible hose bringing water at high pressure (300 bars for example). Tube 32 may be held by perforated centering plates 35 distributed along pipe 20. The downstream end of tube 32 ends in a nozzle or water projection head 36 which may have the construction shown in FIG. 3. This nozzle is provided with a constriction 38 for forming a jet directed substantially perpendicularly to the nozzle, in the circumferential direction of the enclosure. The jet emitted must be at a grazing incidence. In practice, an angle of about 80° from the vertical will be generally appropriate.

Figure 7:
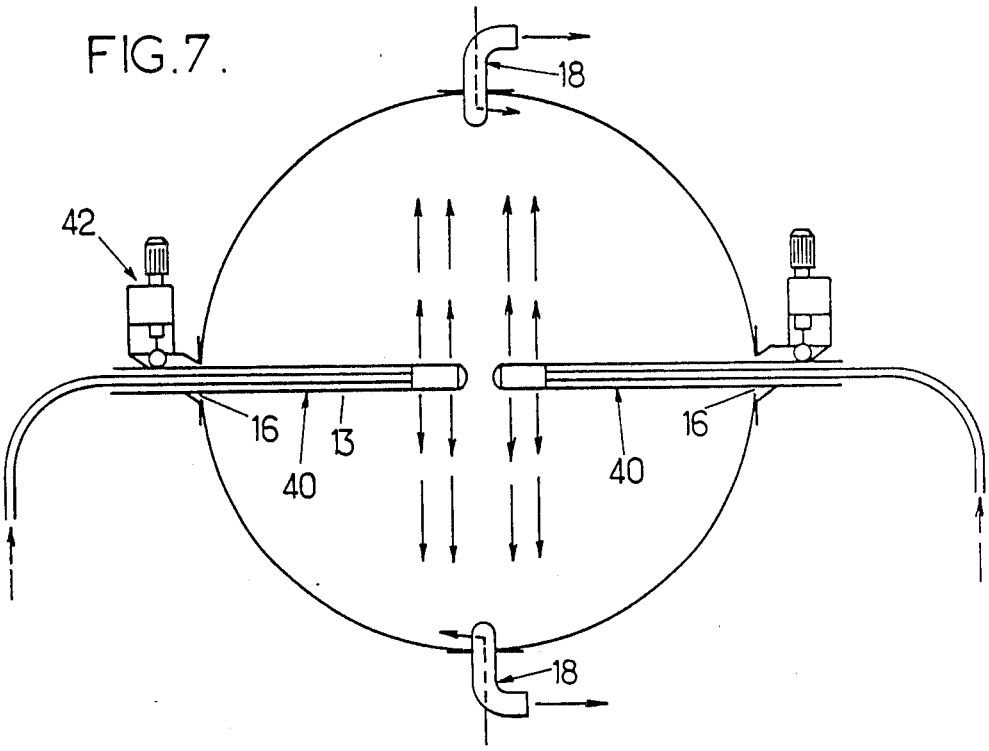
FIGS. 7 and 8 are schematical views, respectively from above and in section through a vertical plane, showing the relative lay out of an assembly according to FIG. 5 and of injection lances.
Figure 8:
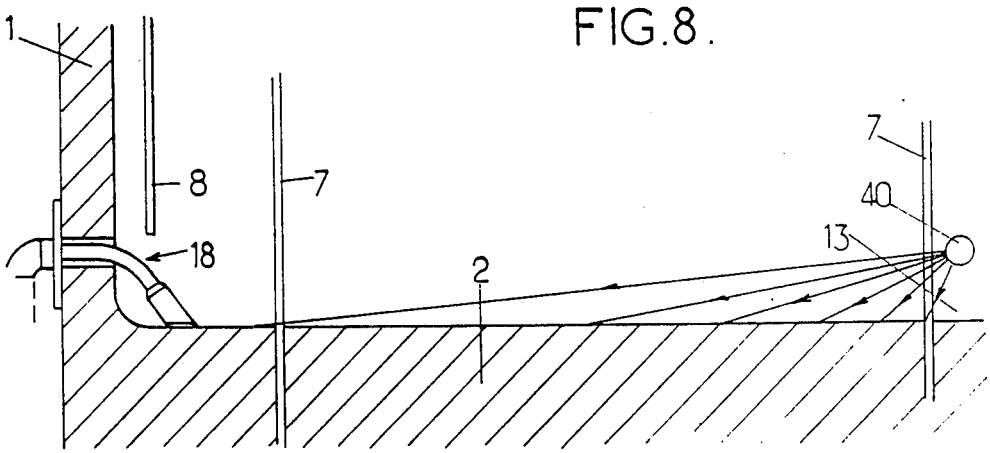

As a general rule, two assemblies of the type shown in FIGS. 2 to 4 will be inserted through opposite "eyeholes" in the enclosure, the nozzles being orientated so as to cooperate for providing a circumferential flow in the same direction over the whole periphery of the plate. FIGS. 7 and 8 show an installation comprising a sludge removal device comprising two assemblies 18 connected to a hydraulic system which may be carried by a vehicle so as to be transportable as a whole from one steam generator to another.

The vehicle may also carry the system for supplying the delivery tubes 40 with pressurized water. FIG. 7 shows the use of two delivery tubes introduced through "eyeholes" 16 placed in the water street. Each of these delivery tubes is movable along its axis by a servomotor assembly 42 fixed to an "eyehole" flange. Each of these servo-motors is controlled, from the system, in synchronism with the water supply to the delivery tubes, so that there is a sequence of feeding jets into each of the ligaments (intertube spaces) of the tube stack 7. The delviery tubes may be formed as described in the patent specification already mentioned. They may be formed from a head and tubular sections connectable together, for rapid assembly and disassembly. Several heads may be used in succession, formed with ports sending jets of water with smaller and smaller impact angles, so as to scavenge the whole of the tubular plate.

FIG. 8 shows for example the case where blasts are fired in succession at angles from 25° to 85°.

If the enclosure also comprises "hand holes", the installation may be completed by additional suction pipes introduced through these holes. It is not necessary to describe here the operation of the installation which follows a cycle similar to that described in French No. 2,514,108 already mentioned.

Figure 5:
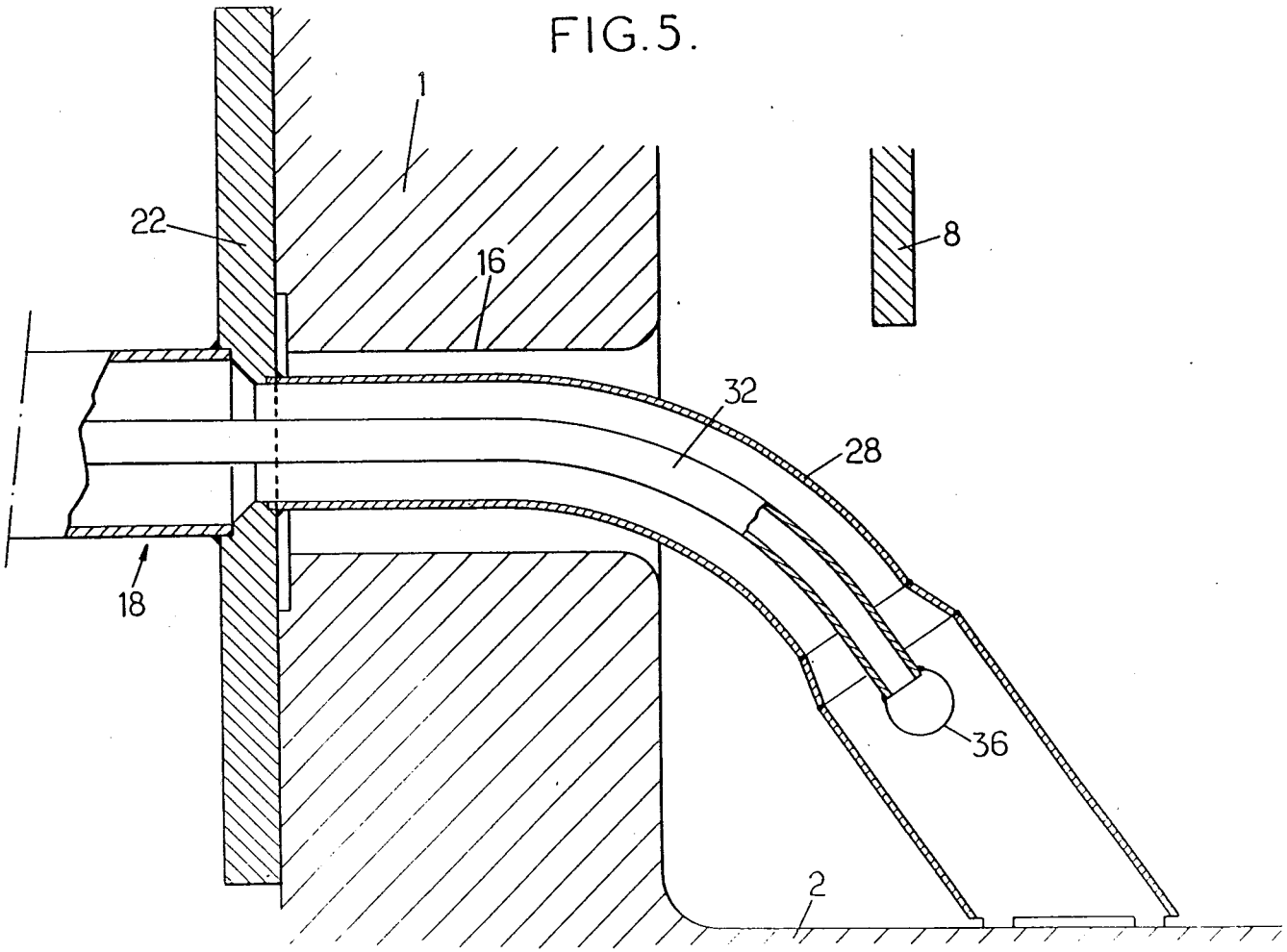
FIG. 5, similar to FIG. 2, shows another embodiment.

The assembly shown in FIG. 5 (where the elements corresponding to those in FIG. 2 are designated by the same reference number) differs from the preceding one essentially by the form given to pipe 28. The curved part of this latter has a radius considerably greater than that of the pipe of FIG. 2. It will be used in the case where the 'hand hole' is close to plate 2 or when the available space between the enclosure and the tube bundle is sufficiently large.

Figure 6:
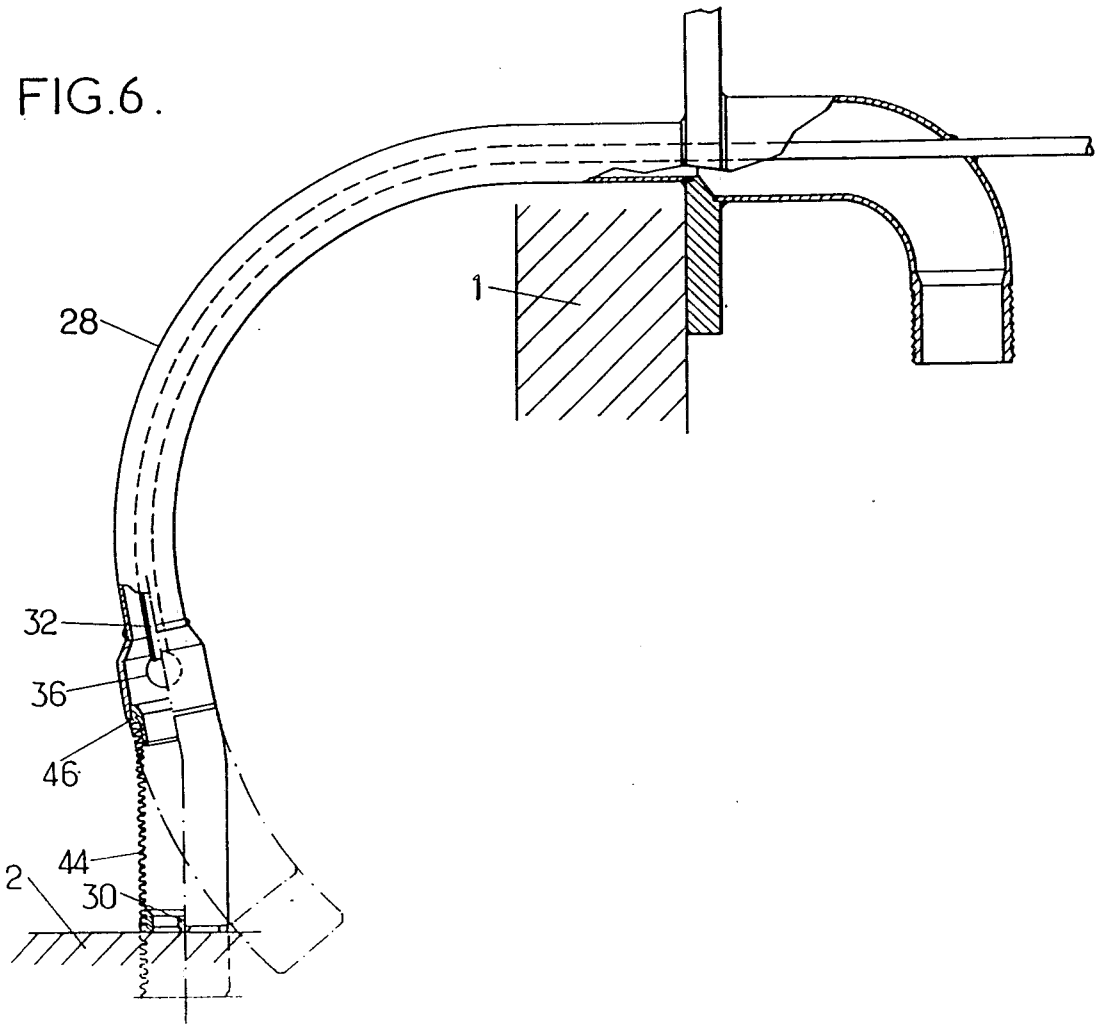
FIG. 6, similar to FIG. 2, shows a suction assembly usable in a sludge removal device forming yet another embodiment.

FIG. 6 shows an assembly forming yet another embodiment, usable when the curvature which must be given to nozzle 28 so as avoid interfering with the tube stack does not allow applying the outlet mouth flat against the tubular plate. In the embodiment shown in FIG. 6, the terminal portion of pipe 28 is formed not by a rigid tube, but by a deformable bellows 44. This bellows is connected by welding to an end piece 46 screwed into the widened end portion of the pipe, through which nozzle 36 passes. When the bellows has the shape shown with a continuous line in FIG. 6, it allows the pipe to be introduced into the enclosure 1. This bellows may have the form shown with a dash dot line so as to bear, through fingers 30 of an end ring, on plate 2. The use of a compressible bellows has the additional advantage of allowing the same assembly to be used for steam generators having variable distances between the "eyeholes" and the tubular plate.

Figure 9:
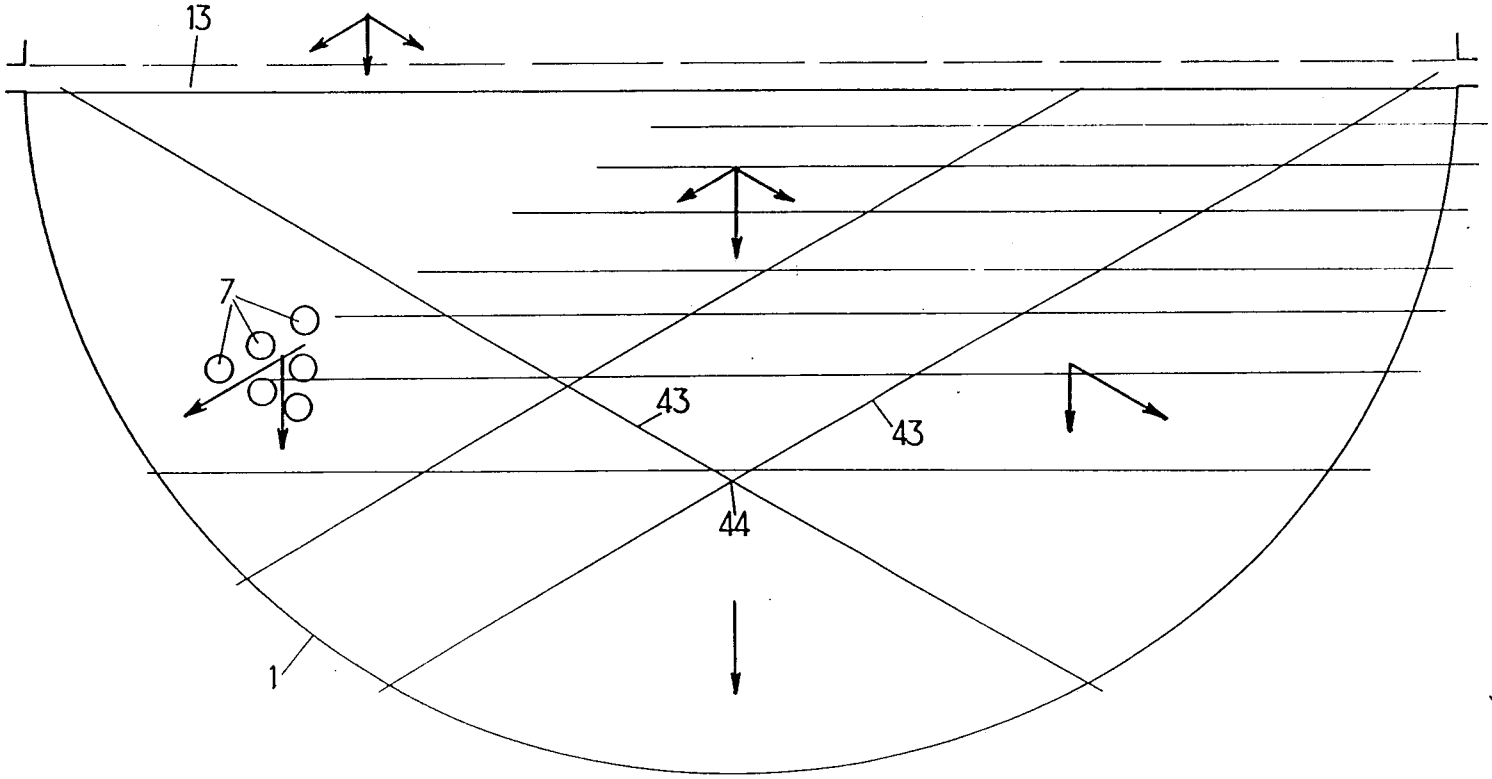
FIG. 9 is a diagram showing the different zones of the tubular plate to be attacked with the lances in the case of exchange tubes arranged with a triangular mesh lattice.

The installation shown in FIGS. 7 and 8 is intended to be used in a steam generator where the tubes are distributed in a square or at least rectangular lattice. But the invention is also applicable to the case of a generator in which the tubes are distributed in a triangular mesh. FIG. 9 shows very schematically the relative lay out of a few tubes 7 in this case. The delivery tube introduced through the water street 13 must then direct jets in the three directions indicated by arrows. For that, it is sufficient to provide a delivery tube comprising ports directed in appropriate directions. Several delivery tubes may also be moved successively along the "water lane", some of which provide oblique jets and not perpendicular to the delivery tube, as is described for example in U.S. Pat. No. 2,112,896.

But it is apparent that the sludge removed by the high pressure jets may, in the case of a triangular mesh lattice, redeposit again, whatever the kind of peripheral flow provided. In one aspect of the invention, this disadvantage is overcome by providing the delivery tubes with ports directed along the three directions of the lattice, slanted with respect to the horizontal so that the different zones of the tubular plate do not all receive the whole of the jets during movement of the delivery tubes. More precisely, it has been found that particularly advantageous results were obtained when the ports are directed so that:

a central zone of the plate, triangular in shape, defined by the water lane 13 and by the point of intersection 44 of two lines 43 starting approximately from the ends of the water lane and orientated along the directions of the lattice oblique to the water street, receive jets in the three directions, an external zone, defined by point 44, the two lines 43 coming from the ends of the water lane and enclosure 1, receives only jets perpendicular to the water street and the two remaining side zones receive jets in one direction perpendicular to the water street and in an oblique direction.

Figure 11:
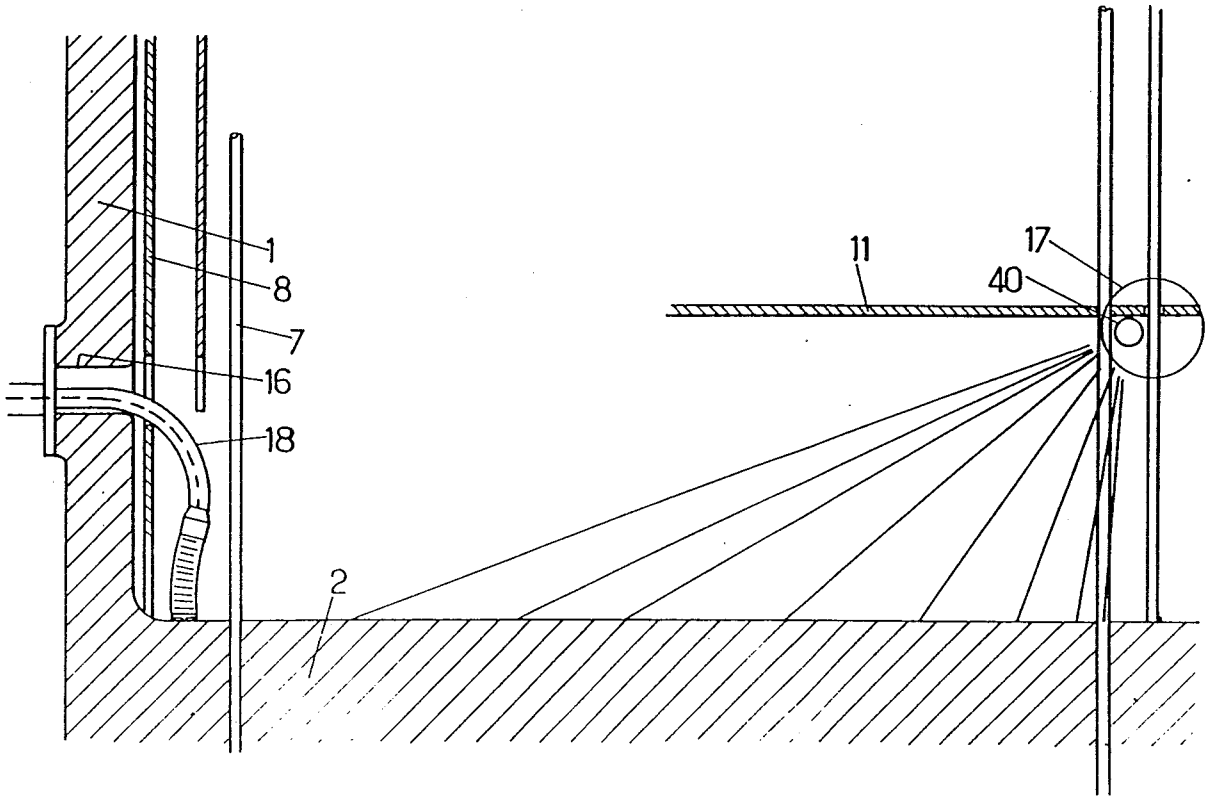
FIG. 11, similar to FIG. 8, shows the use of the lance of FIG. 10.

FIGS. 10, 10A–10D and 11 show how this way of attacking the sludge may be provided by an appropriate arrangement of ports 46–52, only the axes of which are shown in FIGS. 10A to 10D. FIG. 11 further shows an assembly 18 introduced through an "eyehole" 16. Four assemblies of this kind may be introduced through enclosure 1. Two complete assemblies 18 comprising a water projection nozzle may also be provided, the other two assemblies being used solely for suction. Suction only may even be provided, relying on the jets projected by the delivery tubes 40 for providing scavenging.

Figure 12:
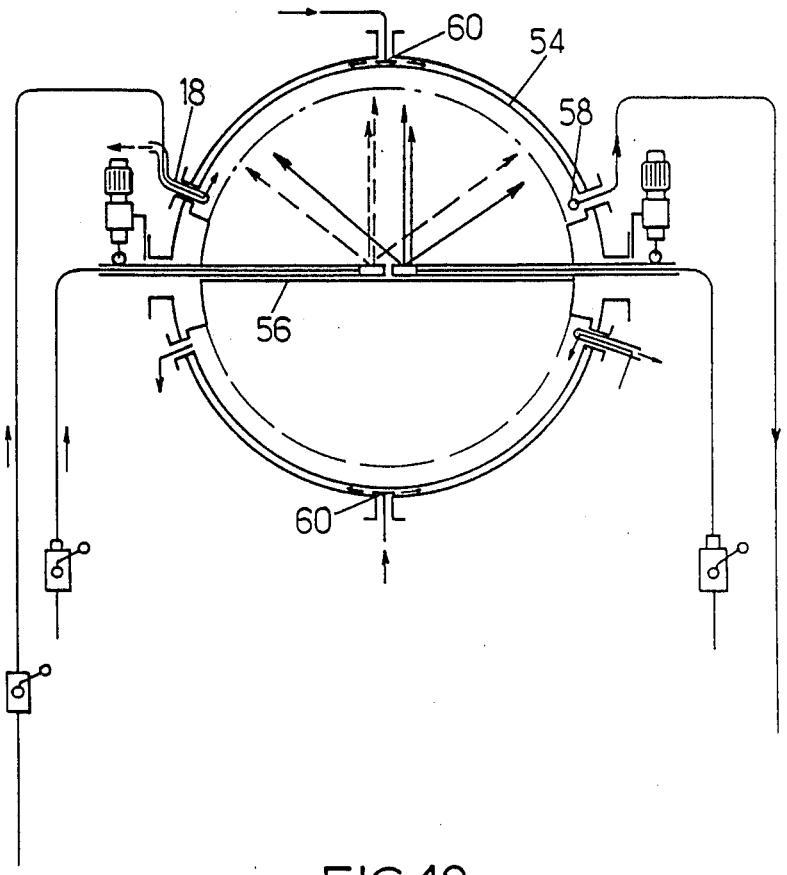
FIG. 12, similar to FIG. 7, shows a possible construction of the device in the case of a triangular mesh lattice.

FIG. 12 shows a sludge removal device for a generator with triangular mesh lattice, of a type having a preheater which divides the base of the secondary part into two half bundles (at the top and at the bottom of the Figures) separated by a median dividing wall 56 and a skirt 54.

The device comprises two delivery tubes 40 of the type shown in FIG. 11, introduced through two opposite hand holes 17. Two removal devices 18, which ensure suction of the sludges in suspension and the injection of scavenging and circulating water, are introduced through diametrically opposite eyeholes at a small angular distance from one of the delivery tubes. Each of the assemblies 18 (one of which is shown) is associated with an assembly 58 which only provides suction of sludge laden water. Two double nozzles 60 introduced through eyeholes, at 90° from the delivery tubes, open into the space between enclosure 1 and skirt 2 and allow high pressure water to be injected for cleaning this space. The water thus introduced is collected by assemblies 18 and 58.

The general construction of the delivery tubes may be one of those described above. As a general rule, a hole allowing pressurized water to flow upwards will be provided for counterbalancing the forces exerted on the delivery tube.

I claim:

1. A sludge removal device for an installation for cleaning the tubular plate of a steam generator comprising, in a cylindrical enclosure closed by the plate, a bundle of parallel tubes connected to the plate and through which flows a primary fluid, comprising at least one assembly insertable into the enclosure through a hole situated above and close to the tubular plate, having: a suction pipe including a curved part insertable into the enclosure through said hole and of a shape such that it terminates in the immediate vicinity of the plate when inserted between the enclosure and the bundle of tubes; and a conduit located in the pipe, for connection to a cleaning liquid supply, ending in a nozzle arranged for projecting water in a transverse direction to the pipe, along a direction at a low angle with the tubular plate and in the circumferential direction of the enclosure.

2. The device of claim 1, wherein said conduit has a liquid delivery head shaped for passing through the lateral wall of the pipe and is held in position in said pipe by perforated centering devices spaced along the conduit.

3. The device of claim 1, wherein the pipe has a curvature such that it is insertable through a small diameter eyehole formed in the enclosure in the immediate vicinity of the plate.

4. The device of claim 1, wherein the pipe has an end deformable section for allowing it to pass through said hole in the enclosure and between said bundle of tubes and the enclosure and to contact the plate.

5. The device of claim 4, wherein the pipe has end fingers for abutment against the plate, wherein the outlet of the pipe with respect to the surface of the tubular plate may be adjusted accurately.

6. An installation for cleaning the tubular plate of a steam generator comprising a device according to claim 1, further comprising cleaning liquid delivery tubes insertable into the enclosure through holes orthogonal to the hole for said assembly, the delivery tubes being provided with fixed orientation nozzles for directing oblique jets towards the tubular plate and means for moving them radially with respect to the enclosure while interrupting the water supply thereto when the delivery tubes are aligned with tubes of the stack.

7. The installation of claim 6, wherein said tubes of the steam generator are U-shaped and define a water lane along a diameter of the enclosure and the delivery tubes are provided for insertion through eyeholes aligned with the water lane whereas two assemblies are provided for insertion each through an eyehole at 90° with respect to the water lane.

8. The installation of claim 7, wherein the tubes of the bundle are distributed in a regular triangular lattice and each delivery tube is provided for directing jets in three directions one of which is perpendicular to the water lane and the others at 60° from the first one.

9. The installation of claim 8, wherein each of said delivery tubes comprises, for each of the three directions, a plurality of nozzles having an orientation with respect to the horizontal such that a central part of the plate receives jets in all three directions, a part of the plate distant from the water lane receives jets solely in a direction perpendicular to the water lane and the remaining parts receive jets perpendicular to the water lane and in a direction at 60° therefrom.

10. The installation of claim 6, further comprising assemblies without water delivery tubes.

11. The installation of claim 6, for a steam generator comprising, at the lower part, a transverse dividing wall and a skirt defining an annular space with the enclosure, comprising: two suction and liquid delivery assemblies penetrating inside the skirt, diametrically opposite and in the vicinity of the dividing wall; two suction assemblies placed substantially opposite said suction and injection assemblies, in the immediate vicinity of the dividing wall; and two cleaning liquid supply nozzles each placed on one side of the dividing wall and opening into said annular space substantially in the middle of the gap between a suction and injection assembly and the suction assembly placed on the same side of the dividing wall.

* * * * *